United States Patent [19]

Smith

[11] 4,408,918

[45] Oct. 11, 1983

[54] HALFSPACE CONTROL SYSTEM FOR ELECTRONIC TYPEWRITER WITH CORRECTION REGISTER

[75] Inventor: Michael H. Smith, New Milford, Conn.

[73] Assignee: SCM Corporation, New York, N.Y.

[21] Appl. No.: 259,722

[22] Filed: May 1, 1981

[51] Int. Cl.[3] ..... B41J 29/16

[52] U.S. Cl. ..... 400/697.1; 400/144.2; 400/303

[58] Field of Search ..... 400/144.2, 303, 477, 400/479, 696, 697.1; 318/696

[56] References Cited

U.S. PATENT DOCUMENTS

| | | | |
|---|---|---|---|
| 3,232,405 | 2/1966 | Walton | 400/303 X |
| 3,270,851 | 9/1966 | Goldsmith et al. | 400/303 X |
| 3,385,415 | 5/1968 | Schrader et al. | 400/303 X |
| 3,515,252 | 6/1970 | Rix et al. | 400/303 |
| 3,578,132 | 5/1971 | Cremasco et al. | 400/303 X |
| 3,780,846 | 12/1973 | Kolpek et al. | 400/697.1 X |
| 3,872,959 | 3/1975 | Wang et al. | 400/303 X |
| 3,893,561 | 7/1975 | Gibbons et al. | 400/303 X |
| 4,145,644 | 3/1979 | Liu | 318/696 |
| 4,258,356 | 3/1981 | Jalbert | 400/479 X |
| 4,322,173 | 3/1982 | Schacht | 400/303 |

OTHER PUBLICATIONS

IBM Technical Disclosure Bulletin, "Rotated page Half-Indexing", Hanna, vol. 24, No. 1B, Jun. 1981, pp. 819-820.

*Primary Examiner*—Ernest T. Wright, Jr.

*Attorney, Agent, or Firm*—Armand G. Guibert; Ernest F. Weinberger

[57] ABSTRACT

An electronic typewriter comprising keys 12*a* and an electronic control system 26 for causing a print wheel 16 to print corresponding characters at successive horizontal positions. A register 86B stores and continuously updates its storage of the last plurality of characters printed. When an error is made, the typist can backspace to the error, automatically recall the incorrect character from the register and erase it by restriking that character via a correction ribbon 28. Actuating a halfspace mode key 24 advances the print wheel's horizontal position by one-half the ordinary space, thereby moving out of normal registration to permit inserting extra characters. Upon such actuation of the halfspace key, the register's contents are cleared so that characters entered in normal registration cannot be used while the print wheel is in an offset location. Characters typed while in halfspace mode are stored in the usual manner. When return to normal registration is desired, the halfspace key is released, again advancing the print wheel's horizontal position by one-half space. Upon such return, the register's contents are again cleared to preclude any non-correspondence between the position of characters taken from the correction register and current registration of the print wheel.

6 Claims, 4 Drawing Figures

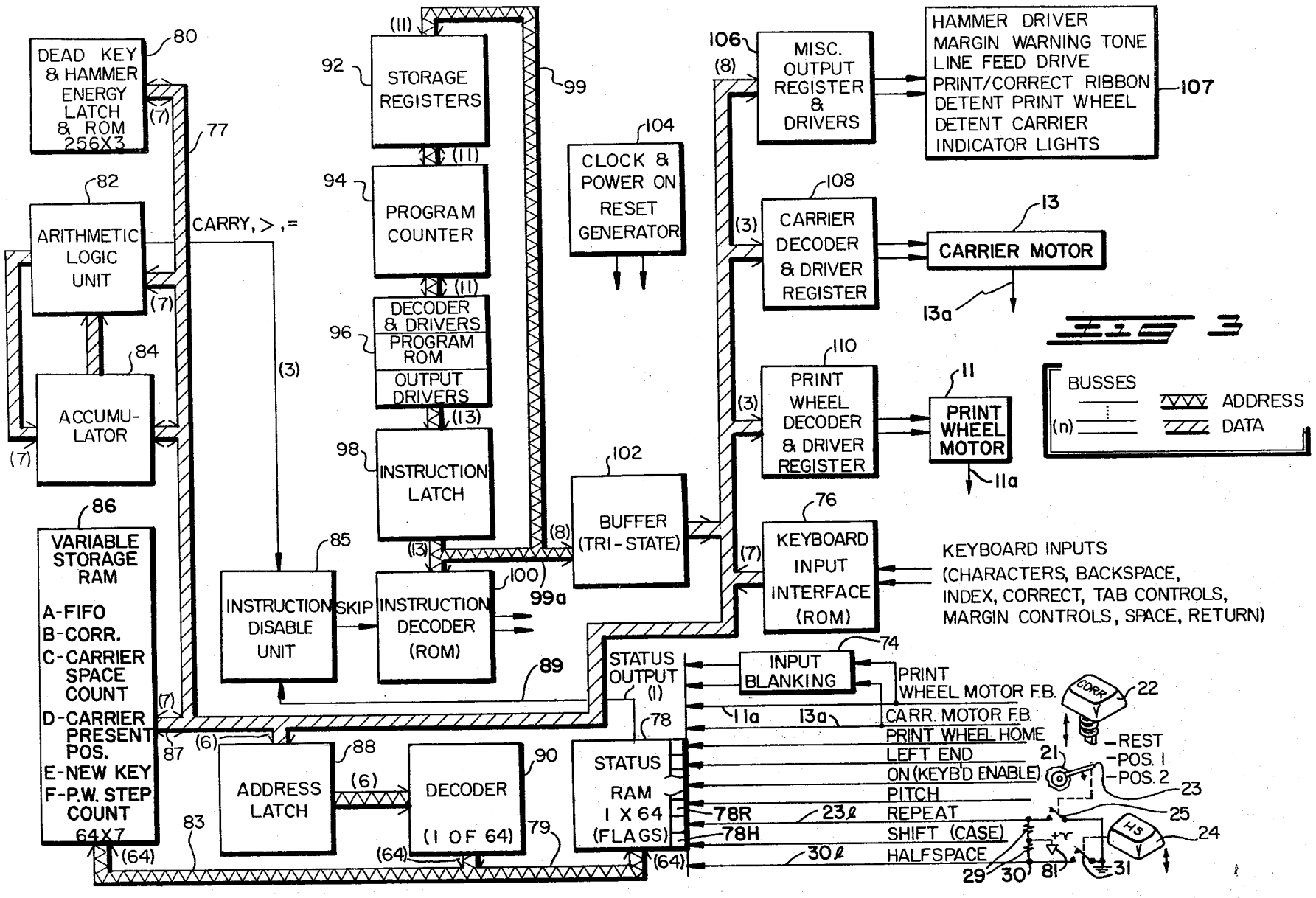
HAMMER DRIVER
MARGIN WARNING TONE
LINE FEED DRIVE
PRINT/CORRECT RIBBON
DETENT PRINT WHEEL
DETENT CARRIER
INDICATOR LIGHTS
107
CARRIER MOTOR
13
13a
PRINT WHEEL MOTOR
11
11a
BUSSES
(n)
ADDRESS
DATA
KEYBOARD INPUTS
(CHARACTERS, BACKSPACE, INDEX, CORRECT, TAB CONTROLS, MARGIN CONTROLS, SPACE, RETURN)
MISC. OUTPUT REGISTER & DRIVERS
106
CARRIER DECODER & DRIVER REGISTER
108
PRINT WHEEL DECODER & DRIVER REGISTER
110
KEYBOARD INPUT INTERFACE (ROM)
76
INPUT BLANKING
74
PRINT WHEEL MOTOR F.B.
CARR. MOTOR F.B.
PRINT WHEEL HOME
LEFT END
ON (KEYBD ENABLE)
PITCH
REPEAT
SHIFT (CASE)
HALFSPACE
REST
POS. 1
POS. 2
CORR
HS
21
22
23
23a
24
25
29
30
30a
31
81
78R
78H
CLOCK & POWER ON RESET GENERATOR
104
BUFFER (TRI-STATE)
102
STATUS OUTPUT
78
STATUS RAM 1 X 64 (FLAGS)
99
99a
100
89
90
79
STORAGE REGISTERS
92
PROGRAM COUNTER
94
DECODER & DRIVERS
PROGRAM ROM
OUTPUT DRIVERS
96
INSTRUCTION LATCH
98
INSTRUCTION DECODER (ROM)
DECODER (1 OF 64)
SKIP
INSTRUCTION DISABLE UNIT
85
ADDRESS LATCH
88
CARRY, >, =
77
80
DEAD KEY & HAMMER ENERGY LATCH & ROM 256X3
82
ARITHMETIC LOGIC UNIT
84
ACCUMULATOR
86
VARIABLE STORAGE RAM
A-FIFO
B-CORR.
C-CARRIER SPACE COUNT
D-CARRIER PRESENT POS.
E-NEW KEY
F-P.W. STEP COUNT
64X7
87
83

HALFSPACE CONTROL SYSTEM FOR ELECTRONIC TYPEWRITER WITH CORRECTION REGISTER

BACKGROUND

1. Field of Invention

This invention relates to typewriters, particularly to a typewriter having an electronic data processing and communication system between the keyboard and the printing mechanism. More particularly, it relates to such a typewriter with error correction and halfspace offset registration features.

2. Description of Prior Art

Heretofore most typewriters contained a keyboard and a mechanical typing mechanism (typebars, ball, or printing wheel) which operated in response to actuation of finger keys on the keyboard. Complex mechanical linkages were provided for coupling motion from the finger keys to the typing mechanism in order to cause the characters selected at the keyboard to be typed. These linkages were awkward and were fraught with other disadvantages.

Recently, so-called "electronic typewriters" have appeared; in these the output of the keyboard consists of electronic signals which are processed in an electronic data processing system within the typewriter to generate suitable control signals for driving solenoids and step- or servo-motors to cause the typing mechanism to print the selected characters. One advantage of electronic typewriters over their mechanical counterparts is the elimination of the complex mechanical linkages between the keyboard and the typing mechanism. Another important advantage is the electronic typewriter's ability to "remember" the last plurality of characters typed so that if an error has been made, the typist can backspace to the location of the error, and automatically have the erroneous character recalled from the electronic memory and retyped over a correction ribbon so as to erase the erroneous character (or several erroneous characters) easily and rapidly, whereafter the correct character(s) can be retyped in the space freed by removal of the erroneous character. One such automatic erasing electronic typewriter is shown in U.S. Pat. No. 3,870,846 to Kolpek and Rahenkamp, granted Dec. 23, 1973.

While such error-correcting electronic typewriters have been able to work satisfactorily, their capabilities were limited because generally they could erase previously-typed erroneous characters and replace them with new, correct characters on a one-for-one basis only. However typing errors cannot always be corrected by a one-for-one erasure and replacement method inasmuch as it is often necessary to replace an erroneous character with several characters, or to replace an erroneous word with a word having more characters than the erroneously-typed word.

For example, assume that a typist types a word without one of its letters, such as the word "patnt", instead of "patent". Also assume that before detecting this error, the typist types one or more additional words. It was not possible, in prior art correcting typewriters, to insert the missing character ("e") in the erroneously-typed word since there was no space or other way to insert the missing character.

Similarly if a typist types a wrong word in a phrase, such as "he is here" when it was desired to have typed "he was here", mere erasure of the erroneous word "is" would not enable an appropriate correction to be made since there is not enough space left to type the correct three-letter word ("was") with leading and trailing spaces in the area occupied by the erroneous two-letter word ("is").

Accordingly, several objects of the present invention are to provide a new and improved electronic typewriter, to provide an electronic typewriter with improved and more versatile correction means, and to provide an electronic typewriter in which corrections can be made which are not restricted to replacement of erroneously-typed characters on a one-for-one basis. Further objects and advantages of the invention will become apparent from a consideration of the ensuing description thereof.

CROSS REFERENCE TO RELATED APPLICATIONS

The following applications describe various other inventions which can be used in a typewriter concurrently with the present invention; these applications also detail various other aspects of the operation and construction of the typewriter discussed in the present application: Relevant applications include the acoustic keyboard systems of Vincent P. Jalbert, Ser. No. 853,778 filed Nov. 21, 1977 and Ser. No. 892,814 filed Apr. 3, 1978, the latter application now U.S. Pat. No. 4,258,356 issued Mar. 24, 1981; Raymond T. Pajer and Pedro T. Guzman, Ser. No. 246,820 filed Mar. 23, 1981; and R. Blanchard, Ser. No. 317,038 filed Nov. 2, 1981.

DRAWING

FIG. 1 is an isometric view of an electronic typewriter according to the invention.

FIG. 1*a* is a schematic presentation of the carrier movements in normal and half-space modes resulting upon depression and release of a half-space control key.

FIG. 3 is a block diagram of the electronic system of the typewriter of FIG. 1 which implements the actions in the flow chart of FIG. 2.

FIG. 1—ELECTRONIC TYPEWRITER

Figure 1:
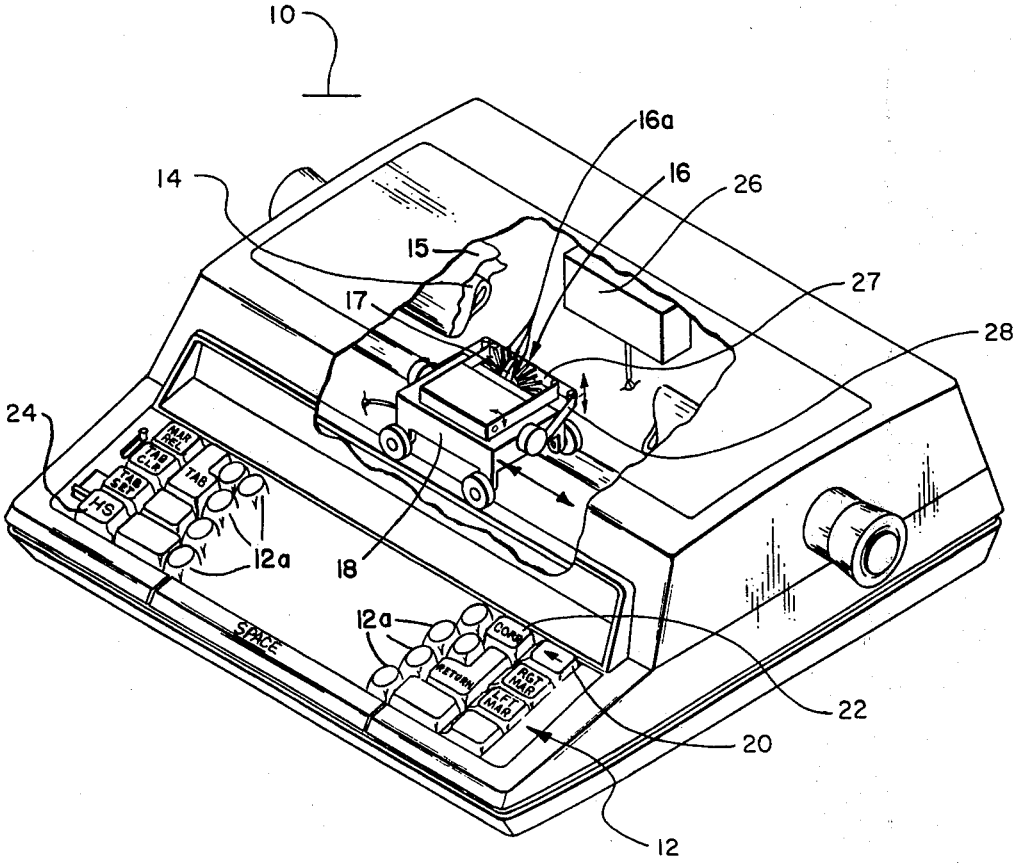

The electronic typewriter 10 of FIG. 1 comprises the usual keyboard 12, platen 14, and printing element 16 supported on movable carrier 18 for that printing element. Printing element 16 is shown as a common print or "daisy" wheel; it has a plurality of radial petals 16*a*, each containing a respective character of keyboard 12, which are struck by a printing hammer 17 over an inked or carboned ribbon 27 onto a sheet of paper 15 supported on platen 14. Keyboard 12 contains the usual character keys 12*a* and control function keys including a backspace key 20, a correction key 22 (depressible to either of two possible positions for purposes described subsequently), and a halfspace key 24. Upon operation of the keys 12*a*, 20, 22, etc. on the keyboard 12, respective electronic signals are generated and are coupled to a control circuit 26 within the typewriter 10. Control circuit 26 has various outputs which control functions and operations of typewriter 10, principally the operation of print wheel 16 and carrier 18.

More specifically, when a key 12*a* on keyboard 12 representing a selected character is depressed, a unique electronic signal representing that key 12*a* will be coupled to control circuit 26, which will in turn generate appropriate signals to cause print wheel 16 to rotate by operating a stepper motor 11 (FIG. 3) so that the petal 16*a* with the character selected is upright, cause the printing hammer 17 to strike that petal 16*a* against platen 14 via print ribbon 27 so as to imprint the character on paper 15 or other recording medium which is positioned around platen 14, and also upon operating another stepping motor 13 (see FIG. 3) to move carrier 18 to the right a distance equal to one character pitch (hereafter one space), either before or after the print operation, so that each subsequent character will be typed one space to the right of the previous character.

Upon each actuation of backspace key 20, a keyboard signal is supplied to control circuit 26 which will in turn provide an operational signal to move carrier 18 one space to the left. If backspace key 20 is held down, carrier 18 will move to the left in successive steps, as long as key 20 is held down.

Actuation of correction key 22 to a partly-depressed position ("Pos. 1" in FIG. 3), enables a correction ribbon 28 for raising to an operative position upon entry of a print character thereafter. Ribbon 28 has either a white overlay substance or adhesive tape, so that when ribbon 28 is raised and struck over a previously-typed character with the petal 16*a* for that same character, the character will be either "whited out" or lifted from paper 15. Thus any previously-typed character can be deleted manually by backspacing to the character, actuating correction key 22 to enable raising of correction ribbon 28, and actuating the key 12*a* of the previously-typed character.

Control circuit 26 also contains a correction register 86B for storing and continuously updating its storage of data representing the last plurality—e.g., ten—of the characters typed. If backspace key 20 is held down, the last plurality of typed characters will be called out of the correction register 6B in reverse order of their storage and put into an electronic position accessible, if necessary, for causing print wheel 16 to retype each character at its previous location.

This "correction memory" feature can be employed to delete any one of the last plurality of typed characters without actuating the key 12*a* for such character. To effect this, the typist will hold backspace key 20 down until the character to be deleted is reached and then depress correction key 22 to its fully-depressed position ("Pos. 2" in FIG. 3). This will enable raising of correction ribbon 28, as before, and also actuate a "repeat" switch 25 via a "common" bail 23 pivoted on a frame member 21. Actuation of switch 25 will apply an appropriate signal (in actuality a ground voltage) on a "repeat" input lead 23*l* to a register 78 (described below, which will cause the character previously typed to be automatically retyped in its previous position, and hence deleted since correction ribbon 28 will be interposed between print wheel 16 and paper 15. (Bail 23 is also operated by several other keys—not shown, but known—on keyboard 12 which normally have a "repeat" function, e.g., the usual underline and period keys among the keys 12*a*.)

Moreover the last plurality of previously-typed characters can be deleted in succession by deeply depressing and holding correction key 22 (at position 2). Typewriter 10 will automatically raise correction ribbon 28, backspace to successive positions, and retype the last plurality of characters in reverse order of their typing, so as to delete such characters in a fully-automatic manner.

Actuation of halfspace key 24 causes a first predetermined voltage (in practice a ground) to be applied to a halfspace input terminal 30 of circuit 26. This will cause carrier 18 to move or be offset one-half space to the right, whereby carrier 18 will be offset from its previous registration, so that additional characters can be squeezed in a space previously opened by use of correction key 22. Specifically, by depressing halfspace key 24, the registration of carrier 18 will be shifted by one-half space to the right in known fashion—one example being U.S. Pat. No. 4,145,144 granted to Liu on Mar. 20, 1979—so that all subsequent printing operations which occur while halfspace key 24 is held down will take a full space, but will symmetrically straddle the character spaces of the previous "normal" registration. For example, an operator would be able, by proper adjustment of the position of the carrier 18 when in the halfspace mode, to type a five-character word in the space previously occupied by a four-character word: the five characters can be typed with normal inter-character spacing, but with only a halfspace separation before and after the five-character word, instead of the usual full space.

When halfspace key 24 is released, a second predetermined voltage (in practice a positive voltage) will be applied to circuit 26. This will cause carrier 18 again to move one-half-space to the right and thereby return to normal registration, so that regular typing can proceed in correct registration.

FIG. 2—FLOW CHART

Figure 2:
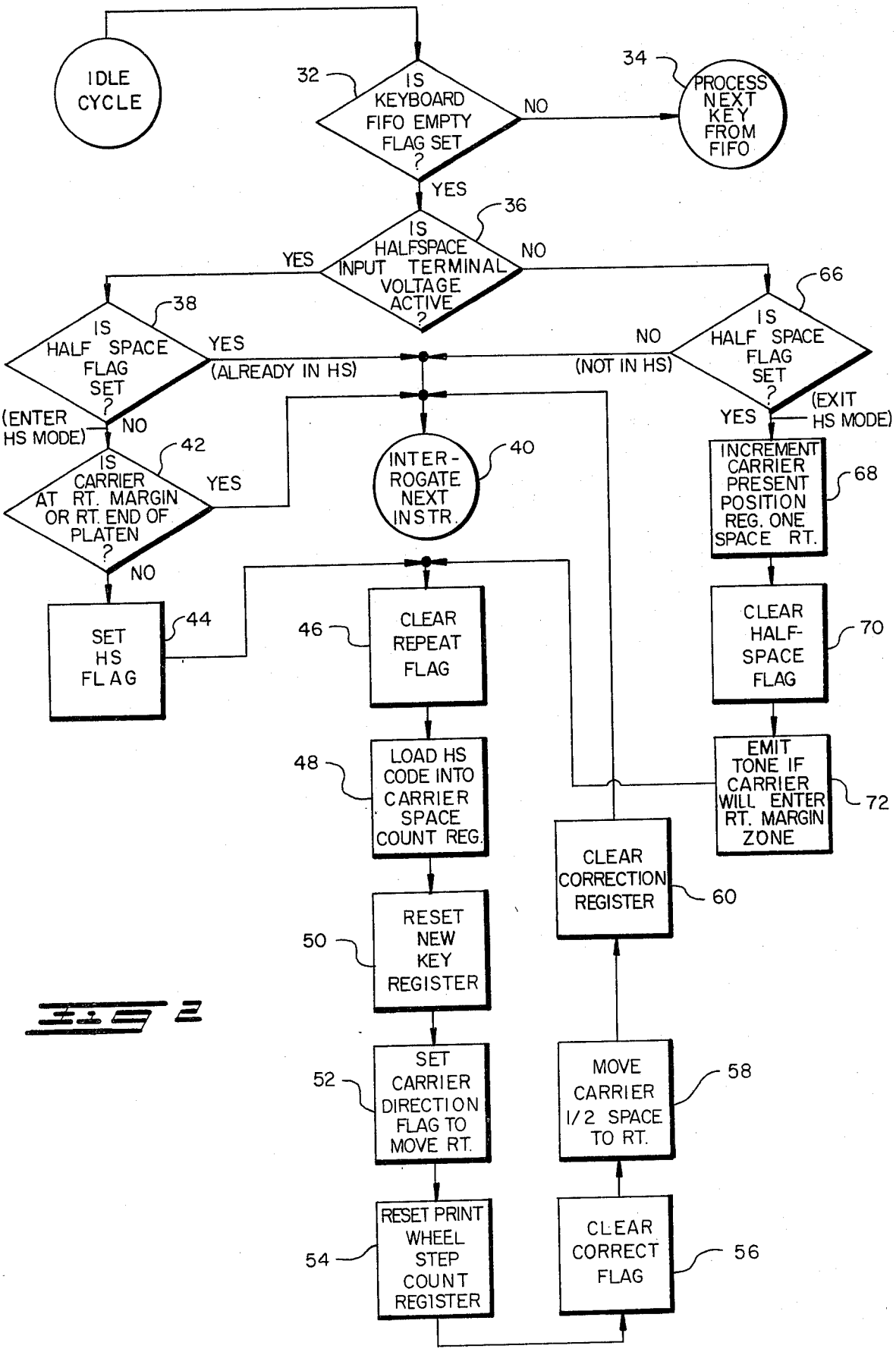
FIG. 2 is a flow chart showing the operations which take place in the typewriter of FIG. 1 in accordance with the invention.

FIG. 2 depicts the operations which occur within control circuit 26 upon any actuation (up or down) of halfspace key 24. The various blocks within FIG. 2 depict individual operations which occur within control circuit 26 and in typewriter 10; the order of progression of the blocks depicts the sequence of these operations, in accordance with well known flow chart terminology.

The machine has a known "idle cycle" during which circuitry within control circuit 26 makes continuous checks or interrogations of various conditions in the machine. The first of these checks pertinent to the present invention is represented by box 32, a diamond-shaped (decision) box; this check sees whether a first-in-first-out (FIFO) storage register 86A—which holds the last several character keys 12*a* actuated (but not yet typed) on keyboard 12—has been emptied. When FIFO register 86A is empty, a "FIFO Empty Flag" (electronic indication) will be provided by means of a predetermined voltage at one point in circuit 26. If FIFO storage register 86A is not empty, the FIFO Empty Flag will not be set or present, indicating that the machine is still in process of typing the last several characters struck. Since these take priority, the machine cannot yet go into the half-space mode, so that the machine temporarily will ignore any actuation of halfspace key 24 and follow the "NO" output of box 32 to circle (exit) box 34; i.e., the machine will continue to process data stored in the FIFO register 86A and representing actuated ones of the character keys 12*a*.

Once FIFO register 86A has been emptied, the FIFO Empty Flag will be present, so that the "YES" output of box 32 will be followed to the next operation, decision box 36.

As indicated in box 36, the machine next makes a periodic check of the input terminal voltage of control circuit 26 leading from halfspace key 24 to determine whether the voltage on this terminal 30 is active, i.e., does the voltage condition indicate that the machine should be or go into a halfspace mode? (In practice this voltage directly sets a stage 78H in a storage register 78 (e.g., a column of addressable single cell or flip-flop stages, designated as Status RAM 78 in FIG. 3 and described in detail subsequently) and it is the condition of such stage 78H—rather than the acutal input terminal voltage—which is checked.)

If halfspace key 24 is being held down, the halfspace input terminal voltage will be active. Thus the machine will follow the YES output of box 36 and will check (box 38) to see if the halfspace flag—an indication that the machine already is in halfspace mode—has been set.

If the halfspace flag has been set, the machine already is in the halfspace mode. It will remain in halfspace mode and proceed (YES to circle box 40) to interrogate or await the next instruction to be presented.

If the halfspace flag has not been set, the machine will be electronically entering the halfspace mode and thus will proceed (NO to box 42) to determine whether carrier 18 is at the right margin or right end of platen 14. If carrier 18 is at the right margin or right end of platen 14, the machine will not be able to go into the halfspace mode since all the spaces available have been used up and it will not be possible to make any move to the right. Thus the machine will proceed (YES to box 40) to interrogate the next instruction; in order to enable continued operation such instruction must be a carrier return, a backspace, or a margin release.

Returning to box 42, if carrier 18 was not at the right margin or the right end of platen 14, the NO output of box 42 will be followed and the halfspace flag will be set, as indicated by the square-shaped (operation) box 44. This flag indicates that the machine has now entered halfspace mode. Setting of the halfspace flag involves changing the condition of a cell or flip-flop in register 78 from an inactive to active condition.

Next the machine will proceed through a series of operations as part of the halfspace entry process. First (box 46) if a repeat flag (indicating that a character is to be continuously typed) has been set, this will be cleared since it would not be desirable to continue this function into the halfspace mode.

Next (box 48) a special code (seven binary ONES representative of the number 127) is loaded into a Carrier Space Count Register 86C to indicate that carrier 18 is to be moved one half-space to the right. Register 86C keeps track of the number of spaces through which carrier 18 must be moved in order to reach a desired new position. The special seven-bit code is required because data bus 87 can transmit a byte of seven bits maximum and Carrier Space Count Register 86C can only keep track of the *full spaces* to be moved. Since the writing line of typewriter 10 of this embodiment spans a maximum of 126 characters (12 pitch or characters per inch), the call for a move of 127 spaces—greater than the available writing line, yet still using only seven bits—is a cue that a special move, i.e., a move of only one-half space is to occur.

Thereafter (box 50) a New Key Register 86E, which stores data for newly-actuated character keys 12*a*, will be reset to zero (cleared) to be sure that no previously stored character will be repeated if a repeat flag is detected after entry into the halfspace mode, but before the next key is depressed.

Next (box 52) a carrier direction flag will be set to insure that the next move of carrier 18 will be to the right, in accordance with the desired mode of operation of the half-space offset register system.

A Print Wheel Step Count Register 86F wil then be reset (box 54) so that print wheel 16 will not move during entry of the halfspace mode.

Then if the correction flag was set previously, it will be cleared (box 56) to cause any previously existent correction mode to be terminated. This is done because when the correction flag has been set, the machine is waiting for either a printable character to be struck (to do a manual correction) or repeat switch 25 to be actuated (to initiate automatic correction). If any other input is received when the correction flag is set, the correction flag is cleared in order to leave the correction mode.

Carrier 18 then will be moved (box 58) one-half space to the right; the machine now is in physical halfspace registration.

Next Correction Register 86B itself will be cleared (box 60) to remove data for the last plurality of characters typed because any prior information in Correction Register 86B will not be valid once the halfspace mode is entered. This is because carrier 18 will be in a different, offset registration while in the halfspace mode and any prior characters stored in Correction Register 86B would be proper only for the normal registration condition. (If correction Register 86B were *not* cleared prior to entering the halfspace mode and a backspace and correction operation were to be made while in the halfspace mode, the correction erasures would be struck over correction ribbon 28 half a space offset from proper registration and thus would not be effective.)

The halfspace entry operation is now terminated and the machine will proceed to interrogate or await the next instruction, if any, as indicated by circle (exit) box 40.

Returning to decision box 36, if the halfspace input terminal voltage is not active, this indicates that halfspace key 24 is up, i.e., the operator has not selected or has terminated the halfspace mode. Thereupon (NO path from box 36 to box 66), a check is made to see if the Halfspace stage 78H or "flag" in Register 78 is set. If it is not set, the machine is not in the halfspace mode and the next instruction will be interrogated (box 40). (This is part of the normal, non-halfspace mode of operation.)

If the halfspace flag is set (YES from box 66), the machine will be exiting the halfspace mode and will thereupon cause a Carrier Present Position Register 86D to increment (box 68) by one count, thereby to account for the two halfspace moves (in and out of halfspace) which the machine will have made by the time the halfspace exit operation is completed. The machine can thereby keep an accurate record of the position of carrier 18, so that certain functions, such as a conventional margin warning bell, will be correctly handled. The machine will also clear the halfspace flag (box 70) and if carrier 18 will move to within a predetermined number of spaces from the right margin, the machine will emit the appropriate warning bell or tone (box 72) to indicate to the typist that the right margin is being approached.

Thereafter the sequence of operations previously discussed (boxes 46 to 60) is completed, including a second halfspace move of carrier 18 (box 58) to return the machine to its original full space registration. Correction Register 86B will again be cleared (box 60)

because any information stored therein will likewise not be valid when the machine returns to its original registration. This terminates the halfspace exit operation so that the machine will now interrogate the next instruction, if any (box 40).

FIG. 3—BLOCK DIAGRAM OF ELECTRONIC SYSTEM—DESCRIPTION

A block diagram of the electronic system of control circuit 26 to effect the operations in the flow chart of FIG. 2 is shown in FIG. 3. In practice, all the components in the control circuit 26 may be formed within a single integrated circuit or microprocessor chip. Appropriate amplification of output signals for driving the printing and other mechanisms will also be provided. In order to facilitate understanding, simplify the explanation, and avoid undue length, only the typewriter components relating to the invention and their ancillary components are detailed. Also only the most important inputs and outputs, data interconnections, and address interconnections of the invention components are shown in the block diagram of FIG. 3. Omitted are details of the other typewriter components and various ancillary circuits and lines to and from the components of the invention since their implementation is readily practicable by those skilled in the microprocessor or logic circuit design arts, given the flow chart of FIG. 2 together with the block diagram of FIG. 3.

As indicated by the legend at the right in FIG. 3, address busses (which generally carry information designating an "address" or location in a memory matrix) are designated by double lines interconnected by zigzag lines, and data busses (which generally carry substantive information) are indicated by double lines interconnected by parallel slant lines. The numbers in parentheses adjacent various busses—e.g., "(7)"—indicate the number of lines or conductors in the bus. As is well known in the art, a seven-conductor bus can transmit data words or bytes of seven bits, and since each bit represents a successive power of two in a summed progression from $2^{\circ}$ to $2^{6}$, such a bus can transmit numbers up to 127.

A Keyboard Interface unit 76 receives inputs directly from keyboard 12; these include inputs designating selected characters, index (line feed), a backspace input (key 20), a correct input (key 22), tab controls, margin controls, space, and return, as indicated.

Preferably keyboard 12 employs an acoustic sending means (not shown, but of the type disclosed in the copending applications identified earlier) and Interface 76 includes a ROM (read-only memory) and other appropriate circuitry which converts the resultant acoustic inputs it receives to appropriate data input signals in a parallel readout format suitable for directly driving print wheel 16 and other mechanical outputs, as detailed in the above-mentioned applications. However, a standard keyboard employing electrical switches throughout can be used instead; in this case Keyboard Interface unit 76 would be of a more common variety.

Status RAM (random access memory) 78 is a register (previously mentioned) having 64 single-bit storage cells or "stages"; it stores the various "flags" to indicate the status of an ongoing operation or any instruction for the machine to follow upon its usual interrogation rounds. RAM 78 as it will often be termed hereinafter for simplicity is periodically polled or interrogated as part of the normal operation of the system in order to determine if any flags are set, and if set (or not set), the system will execute an appropriate subroutine. E.g., when halfspace key 24 is pressed, an appropriate stage (78H) of RAM 78 will become set (block 44 of FIG. 2), thereby to indicate that the machine should enter the halfspace mode. RAM 78 is polled via an address input from address bus 79 which selects a desired stage in RAM 78. RAM 78 thereupon supplies a single output on line 89 indicating the status of the stage selected.

RAM 78 receives eleven control inputs. Starting from the bottom, five come directly from keys or switches on or adjacent keyboard 12, one (pitch selection) comes from a printed circuit board (not shown), but well known in the implementation of electrical circuits, one comes from print wheel 16 to indicate a home position, two come from motors 11, 13 as feedback signals 11*a*, 13*a*, and two come from an Input Blanking Unit 74. The nine direct inputs are as labeled and not all of these will be detailed since they are well-known to those skilled in the art.

With regard to the halfspace input, which is of most interest, when halfspace key 24 (FIG. 1) is depressed, the voltage on the halfspace input terminal 30 to unit 78 will become active; as stated, in practice the voltage on the halfspace input terminal 30 is positive when inactive and falls to a ground level when active, i.e., when halfspace key 24 is depressed. This is indicated in FIG. 3 by connection of the halfspace input lead 30*l* to a positive voltage source 81 via a resistor 29 and the representation of halfspace key 24 by a lead-grounding switch 31. A similar circuit is associated with the repeat input lead 23*l*; however its grounding switch 25 is activated by bail 23.

Two of the other direct inputs to Status RAM 78 (Print Wheel and Carrier Motor Feedback) also go to Input Blanking Unit 74 where they are filtered digitally to reject any spurious signals (spikes less than five microseconds in duration), whereafter each likewise goes to Status RAM 78, but to a separate location. The filtered feedback signals supplied to Status RAM 78 are the ones normally used for movement control. The reason for including the unfiltered feedback signals is that carrier 18 and daisy wheel 16—driven by step motors 11, 13 (FIG. 3) from one position to another in known fashion—are detented (also in known fashion) at each rest position to assure exact print registration. At the start of a move, the previously detented carrier 18 (or daisy wheel 16) is released and an initializing winding turned on for a predetermined delay period to permit the motor 11, 13 to "settle" in the proper initial position. Under production conditions (not described as they do not pertain to the present invention) it was found that occasional units were met where the detent position and "rest" position of a particular drive motor did not coincide to such an extent that "settling" was of longer duration than anticipated. Accordingly, the delay period introduced at the start of each move has been made extendible ("retriggerable") if the state of the cell in RAM 78 responsive to the unfiltered feedback signal of the particular motor 11, 13 indicates the motor 11, 13 is not in proper initial position. Once the delay period has ended, the move is begun and normal response to the filtered feedback signals is permitted.

Referring to the upper lefthand corner of FIG. 3, a Dead Key and Hammer Energy Latch and ROM 80 has 256 stages of three bits each. It receives information from a data bus 77, specifically it receives processed key information from previously mentioned FIFO (first-in-first-out) register 86A—discussed later—and latches (stores) this key information. The stored key information is read when needed to determine if the key is a "dead key" (i.e., the carrier 18 does not advance after printing the key's character, such as a letter which is to have an accent mark typed over it) and also to determine which of four possible hammer energies to use when printing the character—e.g., less energy would be used to print a character with a small area, such as a period ("."), than a character with a large area, such as a "W".

Arithmetic Logic Unit (ALU) 82 receives information from data bus 77 and Accumulator 84. It performs simple arithmetic and logical (comparison) operations, such as the AND and OR functions, addition, subtraction, division, etc. when these operations are required by the system. For example, using Arithmetic Logic Unit 82, the existing number of spaces from the lefthand margin at which carrier 18 is presently positioned can be added with a number representing any incremental movement of carrier 18 in order to provide a sum equal to the new position of carrier 18. ALU 82 also makes appropriate computations to control the carrier return position and computations to calculate the shortest possible path and corresponding direction of rotation when print wheel 16 is to be rotated from one character to another character. ALU 82 supplies a data output to Accumulator 84 and a control output to Instruction Disable Unit 85, the latter being either a carry, greater than, or "equal" output to indicate the result of a comparison.

Accumulator 84 is a temporary storage register which holds information being worked on by ALU 82, in well-known fashion. As indicated, Accumulator 84 receives and supplies information to data bus 77 and ALU 82.

Instruction Disable Unit (hereinafter IDU) 85 receives inputs from ALU 82 and Status RAM 78 and supplies a "skip" output to an Instruction Decoder 100 to cause Program Counter 94 to be incremented by one extra count. I.e., when ALU 82 supplies a comparison ("carry", "greater than" or "equal") output, or when Status RAM 78 supplies an output on line 89 (indicating a set or non-set flag), IDU 85 will supply the above skip signal to Decoder 100, causing the next sequential instruction to be skipped. Thus IDU 85 can effect a skip as the result of a comparison or a flag test. IDU 85 is preferably a known sampling-type latch structure with multiplex input.

Variable Storage RAM 86 has registers which hold variable data, i.e., it has the FIFO Register (A) for storing characters corresponding to keys actuated but not yet printed, the Correction Register (B) for storing the last group of keys actually typed, the Carrier Space Count Register (C), the Carrier Present Position Register (D), plus other variable storage registers not relevant to the present invention. RAM 86 has 64 registers, each capable of holding seven bits of information. In well-known fashion, the information in any selected register in RAM 86 can be read out by providing an appropriate address input on address bus 83 and applying an appropriate one of the well-known WRITE or READ control inputs (e.g., as described in Kolpek et al. U.S. Pat. No. 3,780,846) from Decoder 100 to enable the data to be transferred into or out of RAM 86 via data bus 87 leading from its right side.

Address Latch 88 receives an address from a current instruction being executed and holds it so that such address can be supplied to RAM 86 for enough time for data to be read out or written into the appropriate point in RAM 86, in well-known fashion. Latch 88 supplies the six bits of the address to Decoder 90.

Decoder 90 operates to select one address in RAM 86 or RAM 78 (one of sixty-four stages) at which to write in or read out information.

Storage Register 92 is used for subroutines; it stores addresses to be returned after the subroutine is completed. Register 92 has three stages of eleven bits each.

Program Counter 94 causes the system to operate in accordance with the instructions on the flow chart by selecting appropriate addresses in Program ROM 96. Program Counter 94 does not necessarily cause the system to operate in a sequential mode, but works in association with Storage Register 92 such that when the machine is ready to call any subroutine, the information in Program Counter 94 will be put into a particular stage of Storage Register 92, and after the call is completed, the information will be returned to Counter 94 so as to keep track of the current stage of operation. Also, as stated in the discussion of IDU (Instruction Disable Unit) 85, a sequentially numbered instruction in Counter 94 can be skipped if IDU 85 causes Instruction Decoder 100 to increment Program Counter 94 a second time. Program Counter 94 also can be set to any address by an unconditional branch instruction: this will cause the eleven bits in an Instruction Latch 98 to be passed around on address bus 99 through Storage Register 92, and then to Counter 94, where they will be latched.

Program ROM 96 contains the actual program memory of the system; i.e., in response to sequential or other address inputs from Counter 94, it delivers appropriate instruction, address, and other outputs which cause the machine to operate in accordance with the flow chart of FIG. 2. For example, Program ROM 96 selects appropriate stages of Status RAM 78 to see if flags are set at appropriate times. Program ROM 96 contains an Input Decoder and Drivers and Output Drivers, as indicated. ROM 96 has 1536 stages of thirteen bits each.

Instruction Latch 98 holds the instruction of ROM 96 currently being executed, in well-known fashion.

Instruction Decoder 100 receives the output of Latch 98. Decoder 100 is a ROM which controls the actual physical operation of the machine by gating information in and out of various units of the machine via the bus lines, under control of Program ROM 96. As stated, an instruction can be skipped when IDU 85 supplies a skip input to Decoder 100. The output lines of Decoder 100 are merely indicated in FIG. 3 because such are well-known and including them would make the figure less easy to follow.

Buffer 102 is a tri-state device, i.e., it can supply a binary ONE output, a binary ZERO output, or provide a high input-to-output impedance. It connects the address bus 99*a* on its left side to the outputs of the machine and also connects data into RAM 86 via the data bus 87.

Clock and Power On Reset Generator 104 provides the master clock pulses for the machine and also resets all the registers of the machine (power on reset) when the machine is first turned on. For purposes of simplification and ease of illustration, the various outputs of Generator 104, which lead to most of the blocks in the figure, are not shown, but the connections are well-known to those skilled in the art.

Also not shown is a conventional timer unit for providing various time delays, when required by operation of the machine. Further a conventional power supply and biasing network for energizing the various circuits (e.g., the source 81 supplying voltage +V, as previously mentioned) is not shown either, but typical details are given in the copending applications referenced earlier.

Miscellaneous Output Register and Drivers 106 provides outputs to drive various conventional functions of the machine, such as the printing hammer 17, a warning tone to indicate the selected right margin is being approached, a line feed to rotate platen 14, a print or correct ribbon lift control, detents for print wheel 16 and carrier 18 which hold these elements in a fixed position when not in use, and various indicator lights, as noted at 107 in FIG. 3.

Carrier Decoder and Driver Register 108 drives motor 13 which controls the horizontal position of carrier 18 by causing carrier 18 to move either to the right or to the left, in increments.

Print Wheel Decoder and Driver Register 110 controls motor 11 which rotates printing element 16, thereby to select appropriate characters to be typed.

FIGS. 2 AND 3—OPERATION

The system of FIG. 3 implements the flow chart operations of FIG. 2 in the following manner. When halfspace key 24 on keyboard 12 is depressed, the halfspace input terminal 30 of Status RAM 78 goes active (voltage goes low) and the "halfspace flag" stage 78H of RAM 78 will be set to the active state. RAM 78, as stated, will be polled (interrogated) periodically (via address bus 79) and will provide an appropriate status output to IDU 85.

Before the halfspace flag stage 78H of RAM 78 is interrogated, however, the system first checks (box 32) to see if the keyboard FIFO Empty Flag (also in RAM 78) is set. If set, this indicates that the keyboard FIFO Register 86A is empty. Thereupon the halfspace flag stage 78H of RAM 78 will be checked (box 36) to see if the halfspace input terminal 30 is active.

Returning to box 32, if the keyboard FIFO Empty Flag in RAM 78 was not set, the system will process the next key from the FIFO Register 86A (box 34) and will not proceed any further into the halfspace mode until all previously-actuated keys have been processed, as mentioned earlier.

Continuing with box 36, if the decision in box 36 is YES, i.e., the halfspace input terminal 30 is active (voltage low), the halfspace flag stage 78H in RAM 78 will next be checked (box 38), under control of Program Counter 94, Instruction Disable Unit 85, and Program ROM 96. If the flag stage 78H is already set (YES from box 38), the system is already in the halfspace mode and it will thereupon proceed to interrogate the next instruction (box 40).

In actually, the decision in box 38 is made through the use of a "skip on false flag" instruction, which has been coded to skip on false halfspace flag. Execution of this instruction is started when the instruction is fetched from Program ROM 96 and is latched by Instruction Register 98. Instruction Decoder 100 then initiates the following actions: the Program Counter 94 is incremented by one count so if addresses the next sequential instruction in Program ROM 96. At the same time, the six least significant bits in the Instruction Register 98 are put into data bus 87 through Buffer 102 and these bits are held in Address Latch 88. The group of bits or address in Latch 88 is then decoded by Decoder 90 to address one of the sixty-four locations in Status RAM 78. Since a skip on false halfspace flag instruction is being executed, the latched bits identify the location (78H) of the halfspace flag. The state of the halfspace flag then appears on the Status RAM 78 output line 89, which is connected to the Instruction Disable Unit (IDU) 85. At this point the actual decision is made.

If the output of the Status RAM 78 is true (halfspace flag is set), IDU 85 will not provide a skip input to Instruction Decoder 100, and the execution of the "skip on false flag" instruction is complete. The next instruction (addressed by Program Counter 94), an unconditional branch, is fetched. The unconditional branch instruction causes Program Counter 94 to be set to the address of the start of the section of program associated with box 40. For this purpose, the eleven least significant bits in Instruction Register 98 (which latched the unconditional branch instruction) are passed through Storage Register 92 and are loaded into Program Counter 94 which now addresses the portion of the program (stored in Program ROM 96) associated with box 40. Execution of this portion of the program now proceeds.

If, on the other hand, the output of Status RAM 78 is false (halfspace flag is clear), IDU 85 will provide a skip input to Instruction Decoder 100, which causes Program Counter 94 to increment again by one count. Program Counter 94 then addresses the instruction in Program ROM 96 sequentially following the unconditional branch instruction. The unconditional branch instruction has, therefore, been skipped. Execution of the "skip on false flag" instruction is complete at this point, and execution of instructions (the first of which is pointed to by Program Counter 94) to enter the halfspace mode proceeds as follows:

First, the system will check that entry into halfspace mode is permissible. For this purpose, an appropriate instruction will be loaded from Program ROM 96 into Instruction Register 98 to call for a right-margin or right-end-of-platen test subroutine (box 42), the machine thereupon interrogating the Carrier Present Position Register 86D to see if the count therein indicates that carrier 18 is at the right margin or at the right end of platen 14. This test is accomplished by a count comparison in ALU 82; if carrier 18 is at the right margin or the right end of platen 14, ALU 82 will detect an "equal" and provide a corresponding input to IDU 85. IDU 85 will not provide a skip input to Decoder 100 if ALU 82 detects an equal, whereupon the next instruction—an unconditional branch—will be executed in fashion similar to that described above, and (YES from box 42) the machine will proceed to interrogate an instruction according to the portion of the program associated with box 40.

If the decision in box 42 is NO, i.e., carrier 18 can move further to the right, IDU 85 will deliver a skip input to Decoder 100 and the branch instruction will be skipped. The next subsequent instruction will be reached, i.e., Program Counter 94 will call (box 44) for an instruction from Program ROM 96 to set the halfspace flag (78H) in Status RAM 78. Decoder 100 will enable Status RAM 78 and Decoder 90 will select the appropriate address in Status RAM 78 at which to deliver a "set" input for the halfspace flag.

Next, the repeat flag (78R) is cleared (box 46) in the same sequence of operations as the halfspace flag (78H) was set. Specifically, Program ROM 96 delivers an appropriate instruction into Instruction Latch 98, which in turn presents the captured bits to Instruction Decoder 100 and it enables Buffer 102 so that the repeat flag is placed onto data bus 77 and stored in Address Latch 88, output of which is connected to Decoder 90. Then the location in Status RAM 78 selected by Decoder 90 will be enabled for writing and an appropriate bit written to clear the previously set repeat flag, if said flag was set. If not set, no change will have been made in Status RAM 78.

Next (box 48) a code for a move of one halfspace will be loaded into Carrier Space Count Register 86C according to the following instruction sequence (1) Instruction Latch 98 receives an instruction to write appropriate data in Accumulator 84, Instruction Decoder 100 enabling Buffer 102 which in turn places the halfspace code on data bus 77 such that Accumulator 84 can latch that code. (2) Instruction Latch 98 next receives an instruction to write the data for the move (the code for one halfspace) into Carrier Space Count Register 86C. This code now in Accumulator 84, will be delivered to RAM 86 at the appropriate address determined by Instruction Latch 98. To this end, Decoder 100 first enables the address bits from Latch 98 to be placed on data bus 77 through Buffer 102 and stored in Address Latch 88, the output of which then applies the address to Decoder 90 for selecting the location of Carrier Space Count Register 86C in Variable Storage RAM 86. Decoder 100 thereafter causes Accumulator 84 to output the halfspace code onto data bus 77 from which it is written into the now selected Carrier Space Count Register 86C. As stated, the code for a move of one halfspace is seven binary ONES, representing the decimal number 127.

Next (box 50), New Key Register 86E in Variable Storage RAM 86 will be cleared (i.e., reset to zero). The address will be selected by Address Latch 88 and Decoder 90 and the zeroes will be written in, upon instructions from Decoder 100.

The Carrier Direction Flag is then set to to indicate a rightward move (box 52) in the same sequence as previously done with other flags (e.g., box 46), so that the appropriate stage of Status RAM 78 will contain a "move right" flag.

The Print Wheel Step Count Register 86F is then reset (box 54) by reading a zero into each stage thereof in RAM 86 under control of Decoder 100, in the manner previously described.

Next (box 56), if a correction flag is present in Status RAM 78, that flag is cleared.

Carrier 18 is then actually moved one-half space to the right (box 58) in response to an appropriate instruction from Program ROM 96 as controlled by Program Counter 94 and based upon halfspace code (decimal 127) stored in Carrier Space Count Register 86C. The actual sequence of operations which causes carrier 18 to move one-half space right is relatively detailed and involves a number comparison in ALU 82. Further details of the halfspace move operation are well-known, as described in, e.g., U.S. Pat. No. 4,145,644 to Liu, previously mentioned.

After carrier 18 is moved and such move has been confirmed as part of the carrier move routine, Correction Register 86B in Variable Storage RAM 86 is cleared (box 60) to prevent any previous character stored during the normal registration mode from being utilized during the halfspace mode since such information would be in improper registration if it were to be struck over the correction ribbon 28 during halfspace registration. In one preferred embodiment, Correction Register 86B comprised ten bytes (seven bits each) so as to store the last ten characters typed.

After Correction Register 86B has been cleared, the halfspace entry operation is terminated and the system will be ready for executing the next instruction (box 40).

Figure 1A:
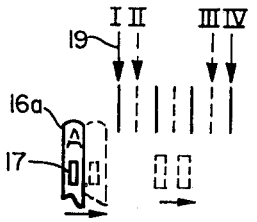

Halfspace key 24 must be held down during the halfspace mode. While key 24 is held down, any subsequent typing operations may be performed and these will occur in normal full-space sequence, albeit one-half space out of registration with the normal typing (as evident from FIG. 1*a*). In one preferred embodiment of the invention, after a character key 12*a* is actuated, carrier 18 moves one space right and then the character is typed. An arrow 19 (see FIG. 1*a*, equivalent to any of the conventional visual indicators used on typewriters to alert the operator as to the current print position) is provided on carrier 18 to point one space ahead of the present carrier position to indicate where the machine will type the next character. Postulating halfspace key 24 to have been depressed with carrier 18 in normal registration (solid lines in FIG. 1*a*), the next printing position for hammer 17 thereon being at I in FIG. 1*a*, as indicated by arrow 19 (solid-line representation), then when the halfspace entry move occurred, carrier 18 (and the arrow 19 thereon) moved one-half space rightward from position I to position II—i.e., into offset registration (dashed vertical lines in FIG. 1*a*), the new print position being indicated similarly by a dashed-line representation of arrow 19. Thus if the halfspace key 24 and a character key 12*a* are actuated, the character will be typed one and a half spaces beyond the current position of carrier 18. As stated previously, subsequent character entries will occur with normal spacing but out of normal registration, as shown by the distance between successive marks in off-set registration (the subsequent dashed vertical lines in FIG. 1*a*).

When the halfspace key 24 is released (box 30), the voltage on the halfspace input line 30*l* to Status RAM 78 will become inactive or high again.

As part of its routine interrogation rounds, the FIFO Empty Flag in Status RAM 78 will be checked (box 32) and if any characters remain to be typed, the machine will not leave the halfspace mode, but will process the data for these keys (box 34).

If the FIFO Empty Flag is set, the machine will proceed (box 36) to determine whether the halfspace input terminal voltage flag in Status RAM 78 is active. Since it now is inactive, there will be NO decision, whereupon the machine will then check (box 66) the halfspace flag in Status RAM 78. The flag will still be set because the machine was in the halfspace mode so that a YES decision will be made; thus an appropriate instruction from Program ROM 96 will be called to increment the Carrier Present Position Register 86D by one count, corresponding to a full space to the right (box 68), thereby to adjust the count in register 86D to reflect the true position of carrier 18 to account for two halfspace moves (in and out of halfspace registration).

Thereupon the halfspace flag (78H) will be cleared (box 70) in Status RAM 78 and Carrier Present Position Register 86D will be checked (using a count comparison in ALU 82) to see if the carrier 18 is at the start of the right margin zone (box 72). If so, a warning tone will be generated.

The machine will then proceed through boxes 46 to 60, as discussed. Note that in these steps carrier 18 will move another halfspace right (box 58)—e.g., from position III to position IV in FIG. 1*a*—to return carrier 18 to normal registration. After Correction Register 86B is cleared again (box 60), the next halfspace operation will be completed and the machine will be ready to interrogate a new instruction (box 40).

While the above description contains many specificities, these should not be considered limiting, but rather an exemplification of one presently preferred embodiment of the invention. Many other embodiments will be visualized by those skilled in the art. For example, in lieu of applying the halfspace input to Status RAM 78 by means of a switch 31 as described, the halfspace can be a keyboard input to Interface 76, whereupon it will be processed through Key ROM 80 and stored in FIFO 86A of Variable Storage RAM 86. In this case some provision for providing a halfspace exit should be made, e.g., by providing a signal on release of the key 24, by a second actuation of the key 24, etc. In lieu of a print (daisy) wheel 16, an equivalent ball-shaped or other printing element can be used. Appropriate changes in the program will thus be necessary, but these will be obvious to those skilled in the art. In lieu of incrementing the Carrier Present Position Register 86D by one count after the halfspace exit operation, the incrementations could be made upon halfspace entry. In lieu of the system shown, which can be implemented by means of a custom integrated circuit, it will be obvious to one skilled in the art to implement the invention by means of discrete devices or a plurality of standard microprocessor and EDP components. The invention has been emulated by means of a standard 8085 microprocessor, made by Intel Corporation, Santa Clara, Calif., together with Model 2114 and 2116 RAMS (Intel), a Model 74LS240 Buffer (tri-state device) Texas Instruments, Dallas, Tex.), and Model 74LL373 or 74LL374 Latches (Texas Instruments). In this case, the operations were substantially the same as those described, differing in the more general instruction set used for the 8085 microprocessor. Therefore, the true scope of the invention should be determined only by the appended claims and their legal equivalents.

What is claimed is:

1. A halfspace control system for a typewriter comprising a keyboard containing character keys; an electronic system responsive to electrical outputs from said keyboard for generating control signals; mechanical striking means capable of striking any of the characters from said keyboard against a platen and moving across said platen, said mechanical striking means being responsive to said control signals for striking selected characters, corresponding to those selected upon operation of said keyboard, against said platen and moving a predetermined distance in a predetermined direction across said platen upon the striking of each character against said platen; storage means within said electronic system for storing and continuously updating its storage of the last plurality of characters struck against said platen; backspace and correction means within said electronic system for selectively causing said striking means to move in discrete steps, each step being of said predetermined distance, in a direction opposite to said predetermined direction and for selectively restriking the characters stored in said storage means in registration with the respective positions previously struck against said platen; a halfspace manually controllable input means within said typewriter; and halfspace control means within said electronic system responsive to a first operation of said halfspace input means for (A) causing said mechanical striking means to move across said platen by one-half said predetermined distance and (B) erasing the contents of said storage means in conjunction with execution of said half-distance motion of said striking means across said platen.

2. The typewriter of claim 1 wherein said mechanical striking means comprises a movable printing element containing all the characters of said keyboard at different positions on said striking means and a movable carrier for said printing element for moving said printing element in said predetermined direction or the reverse of said predetermined direction across said platen, said backspace and correction means being arranged selectively to move said carrier in said reverse direction in said discrete steps and to move said printing element into its respective position in accordance with the characters previously struck against said platen, and in accordance with the characters in said storage means, for each respective step of said carrier, up to the number of the plurality of characters stored in said storage means.

3. The typewriter of claim 1 wherein said storage means also stores and continuously updates its storage of the last plurality of characters struck against said platen after its contents have been erased and said mechanical striking means has executed said half-distance motion.

4. The typewriter of claim 3 wherein said halfspace input means is arranged to provide first and second operations and said halfspace control means within said electronic system is also responsive to the second operation of said halfspace input means for (A) causing said mechanical striking means again to move across said platen by one-half said predetermined distance, and (B) erasing the contents of said storage means in conjunction with execution of said second half distance motion of said striking means across said platen.

5. The typewriter of claim 4 wherein said halfspace input means is a switch on said keyboard, the first operation of said halfspace input means being a movement of said switch from a first position to a second position and a resultant change in electrical output to said electronic system from a first condition to a second condition, the second operation of said halfspace input means being a movement of said switch back to said first position and a resultant change in said electrical output to said electronic system back to said first condition.

6. The typewriter of claim 5 wherein said switch is a momentary contact type switch and comprises a key on said keyboard, said first position of said switch being a raised position and said second position of said switch being a depressed position.

* * * * *